US007393594B2

(12) United States Patent
Yamasaki et al.

(10) Patent No.: US 7,393,594 B2
(45) **Date of Patent: *Jul. 1, 2008**

(54) LAMINATED METAL THIN PLATE FORMED BY ELECTRODEPOSITION AND METHOD OF PRODUCING THE SAME

(76) Inventors: Tohru Yamasaki, 1778-1-307, Matogata, Matogata-cho, Himeji-shi, Hyogo (JP); Takayasu Mochizuki, 6-40-3, Honmachi, Shibuya-ku, Tokyo (JP)

( * ) Notice: Subject to any disclaimer, the term of this patent is extended or adjusted under 35 U.S.C. 154(b) by 211 days.

This patent is subject to a terminal disclaimer.

(21) Appl. No.: 10/985,982

(22) Filed: Nov. 12, 2004

(65) Prior Publication Data

US 2005/0103637 A1 May 19, 2005

(30) Foreign Application Priority Data

Nov. 14, 2003 (JP) ..... 2003-420129

(51) Int. Cl.

| | |
|---|---|
| ***B32B 15/01*** | (2006.01) |
| ***C25D 1/20*** | (2006.01) |
| ***C25D 5/14*** | (2006.01) |
| ***C25D 7/00*** | (2006.01) |

(52) U.S. Cl. ..... 428/610; 428/635; 428/675; 428/680; 428/935; 205/67; 205/181

(58) Field of Classification Search ..... None
See application file for complete search history.

(56) References Cited

U.S. PATENT DOCUMENTS

| | | | | |
|---|---|---|---|---|
| 4,511,438 | A * | 4/1985 | DiStefano et al. | 428/586 |
| 4,652,348 | A * | 3/1987 | Yahalom et al. | 205/104 |
| 5,250,172 | A * | 10/1993 | Vargas-Gutierrez et al. | 205/70 |
| 5,320,719 | A * | 6/1994 | Lasbmore et al. | 205/104 |
| 5,393,405 | A * | 2/1995 | Iacono et al. | 205/72 |
| 6,442,039 | B1 * | 8/2002 | Schreiber | 361/760 |
| 6,547,944 | B2 * | 4/2003 | Schreiber et al. | 205/96 |
| 2002/0071962 | A1 * | 6/2002 | Schreiber et al. | 428/635 |
| 2004/0031691 | A1 * | 2/2004 | Kelly et al. | 205/104 |
| 2005/0045252 | A1 * | 3/2005 | Yamasaki et al. | 148/508 |

FOREIGN PATENT DOCUMENTS

| | | | |
|---|---|---|---|
| JP | 04-124292 | * | 4/1992 |
| JP | 2001-342591 | | 12/2001 |
| JP | 2003-78078 | | 3/2003 |

OTHER PUBLICATIONS

Translation of JP 2001-342591.*

* cited by examiner

*Primary Examiner*—John J. Zimmerman
(74) *Attorney, Agent, or Firm*—Foley & Lardner

(57) ABSTRACT

A laminated metal thin plate produced by electrodeposition is composed of a plurality of metal layers provided by at least two kinds of materials different in composition from each other. The laminated metal thin plate includes a first layer excellent in mechanical characteristics and/or chemical resistance and a second layer excellent in electrical characteristics such as electrical conductivity. The first and the second layers are adhered to each other in atomic level directly at their interface, with composition gradient at their interface, or with an adherence buffer layer such as a copper thin film interposed therebetween. The first layer is at first deposited on an electrode substrate. The second layer is deposited on the first layer. Deposition is repeatedly carried out in such a way that the first layers on opposite sides of the second layer are equal in thickness. Finally, the electrode substrate is dissolved and removed.

9 Claims, 2 Drawing Sheets

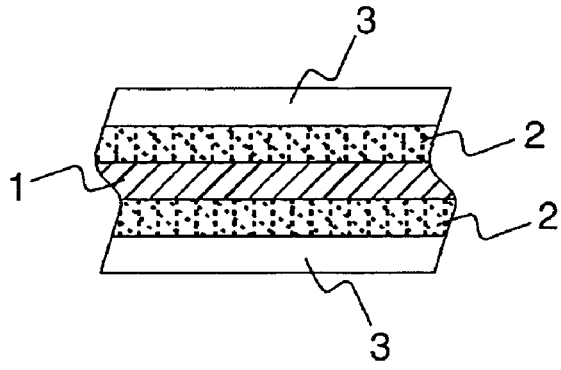
FIG. 1
FIG. 2A
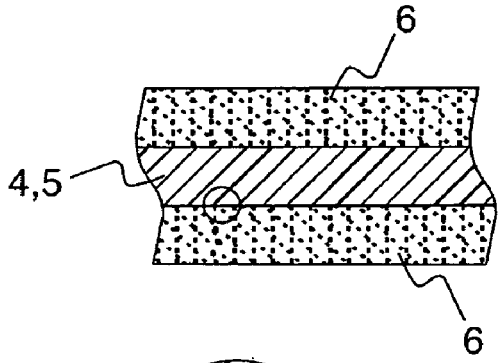
FIG. 2B
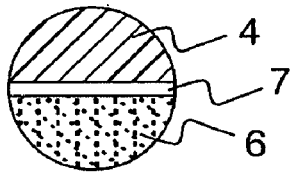
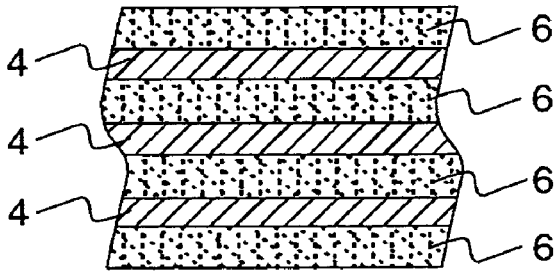
FIG. 3

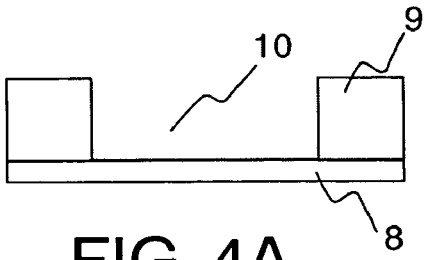
FIG. 4A
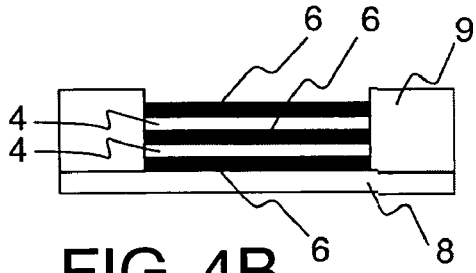
FIG. 4B
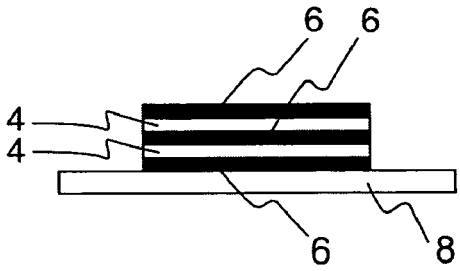
FIG. 4C
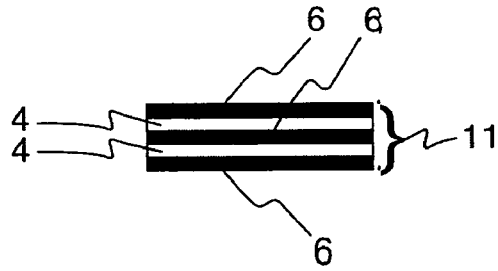
FIG. 4D
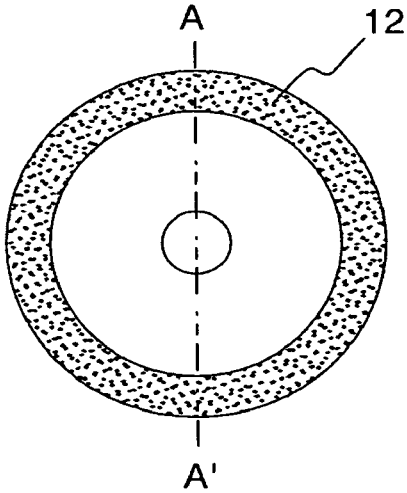
FIG. 5A
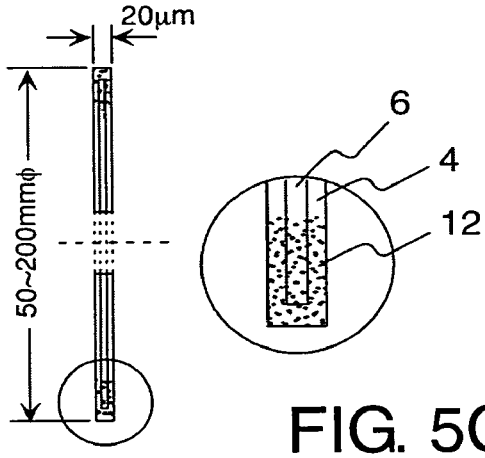
FIG. 5C
FIG. 5B

LAMINATED METAL THIN PLATE FORMED BY ELECTRODEPOSITION AND METHOD OF PRODUCING THE SAME

This application claims priority to prior Japanese patent application 2003-420129, the disclosure of which is incorporated herein by reference.

BACKGROUND OF THE INVENTION

This invention relates to a metal thin plate produced by electrodeposition, to a method of producing the metal thin plate, and to a rotary blade cutter produced by the method.

By combining electrodeposition with lithography, it is possible to produce a metal microstructure necessary for micromachines and micro parts. In the electrodeposition, nickel is widely used as an electrodeposited metal material. This is because nickel is relatively easily electrodeposited. Therefore, it is attempted to use a metal thin plate of electrodeposited nickel for micro electronics components, such as spiral contactors, which require a spring function (see Japanese Patent Application Publication (JP-A) No. 2003-78078). However, a metal structure formed by the electrodeposited nickel has drawbacks as follows. That is, plastic deformation called creep deformation is caused even under a stress load lower than a yield stress. Furthermore, even in a relatively low temperature region at and above the room temperature, crystal grain growth occurs so that the electrodeposited nickel is softened. As a result, the spring function is gradually lost with an increase in time period of use. Furthermore, although precision electrodeposition is relatively easy, nickel is fragile and is therefore susceptible to mechanical damage. Accordingly, as a material of a high-speed rotary blade cutter, the lifetime of nickel is too short.

In the meantime, development has been made of a technology of producing a nickel-tungsten (Ni—W) alloy thin plate by electrodeposition as an ideal material which compensates for the above-mentioned mechanical disadvantages of nickel (see Japanese Patent Application Publication (JP-A) No. 2001-342591). However, the nickel-tungsten alloy has an electrical conductivity corresponding to only about one tenth of that of nickel. Thus, the nickel-tungsten alloy has a critical defect for use as an electro-conductive material. Furthermore, the nickel-tungsten alloy is low in alkali resistance though high in acid resistance.

SUMMARY OF THE INVENTION

It is an object of this invention to provide a laminated metal thin plate formed by electrodeposition, which is capable of simultaneously realizing a high mechanical strength, a high toughness, a high temperature-stability, a high chemical resistance, and a high electrical conductivity.

It is another object of this invention to provide the laminated metal thin plate of the type described, which is suitable for use as a material for micromachines and microparts.

It is still another object of this invention to provide a method of producing, by electrodeposition, the laminated metal thin plate of the type described.

It is yet another object of this invention to provide a rotary blade cutter produced by the method of the type described.

According to an aspect of the present invention, there is provided a laminated metal thin plate produced by electrodeposition, comprising a plurality of metal layers provided by at least two kinds of materials different in composition from each other, the metal layers being laminated integral with each other in atomic level at their interface.

According to another aspect of the present invention, there is provided a method of producing, by electrodeposition, the above-mentioned laminated metal thin plate, the method comprising preparing an electrode substrate, successively electrodepositing a plurality of metal layers provided by at least two kinds of materials different in composition from each other on the electrode substrate, and finally dissolving the electrode substrate to form the laminated metal thin plate having an integral structure.

According to still another aspect of the present invention, there is provided a rotary blade cutter produced by the above-mentioned method. The metal layers of the rotary blade cutter comprise a core layer of a disk-like shape and a cover layer covering all of outer surfaces of the core layer. The cover layer is provided by one of the materials and has a high chemical resistance. The core layer comprises a nickel-tungsten alloy layer as another one of the materials.

This invention may be understood as follows. A laminated metal thin plate produced by electrodeposition comprises a plurality of metal layers provided by different kinds of materials different in composition from each other. The metal layers include a first layer or layers excellent in mechanical characteristics and/or chemical resistance and a second layer or layers excellent in electrical characteristics such as an electrical conductivity. The metal layers are adhered to each other in atomic level directly at their interface, with composition gradient at their interface, or via an adherence buffer layer such as a copper thin film interposed therebetween so as to form the laminated metal thin plate having a high-adhesion integral structure. The laminated metal thin plate is produced by successively and alternately electrodepositing the first and the second layers on an electrode substrate in such a way that the second layer is sandwiched between the first layers equal in thickness to each other, and finally dissolving and removing the electrode substrate. Thus, the laminated metal thin plate excellent in mechanical characteristics and/or chemical resistance and also excellent in electrical characteristics is obtained. Especially in case where the first layer is a nickel-tungsten alloy layer and the second layer is a nickel layer or a copper layer, the laminated metal thin plate can be easily produced and has excellent characteristics.

BRIEF DESCRIPTION OF THE DRAWING

FIG. 1 is a schematic sectional view showing a laminated metal thin plate according to a first embodiment of this invention;

FIG. 2A is a schematic sectional view showing a laminated metal thin plate according to a second embodiment of this invention;

FIG. 2B is an enlarged view showing an encircled part in FIG. 2A;

FIG. 3 is a schematic sectional view showing a laminated metal thin plate according to a third embodiment of this invention;

FIGS. 4A through 4D are views for describing a method of producing a laminated alloy thin plate according to a fourth embodiment of this invention;

FIG. 5A is a plan view of a rotary blade cutter according to a fifth embodiment of this invention;

FIG. 5B is a sectional view taken along a line A-A in FIG. 5A; and

FIG. 5C is an enlarged view showing an encircled part in FIG. 5B.

DESCRIPTION OF THE PREFERRED EMBODIMENTS

Now, description will be made of several preferred embodiments of this invention with reference to the drawing.

First Embodiment

Referring to FIG. 1, a laminated metal thin plate according to a first embodiment of this invention comprises a plurality of metal layers provided by at least two kinds of materials different in composition from each other and integrally adhered to each other in such a way that the metal layers are symmetrically arranged in a thickness direction with respect to the center of thickness. Specifically, a first metal layer 1 is located at the center and is sandwiched between second metal layers 2. On the second metal layers 2, third metal layers 3 are laminated. Thus, the laminated metal thin plate has a symmetrical structure. As these metal layers 1, 2 and 3, suitable materials are selected so that these layers can be adhered at their interfaces with a sufficiently high adhesive strength. If necessary, another metal layer different in composition from the third metal layer 3 may be adhered to an outer surface of each of the third metal layers 3.

When adjacent ones of the metal layers are integrally adhered to each other, the metal layers different in composition may be attached to each other directly at their interface. Alternatively, the metal layers adhered to each other may be gently changed in composition around their interface, i.e., may have a graded composition or composition gradient around their interface so as to further enhance the adhesive strength.

By providing such a symmetrical structure, it is possible to obtain the laminated metal thin plate suppressed in bending or flexural deformation by canceling a residual stress produced at the interface between different kinds of metal layers. In the symmetrical structure, an inner layer is formed by the metal layer excellent in electrical conductivity while an outer layer is formed by the metal layer excellent in chemical resistance and/or mechanical characteristics. With this structure, the laminated metal thin plate is given excellent electrical characteristics as well as excellent mechanical characteristics and/or an excellent chemical resistance.

Second Embodiment

Referring to FIG. 2A, a laminated metal thin plate according to a second embodiment of this invention is composed of a plurality of metal layers including different kinds of materials different in composition from each other. Specifically, when a nickel (Ni) layer 4 or a copper (Cu) layer 5 is located at the center and is sandwiched between nickel-tungsten (Ni—W) alloy layers 6, the laminated metal thin plate is easy in production and has desired characteristics. The thickness of each of these layers may be 0.1 to 50 μm.

The Ni—W alloy layer 6 formed on opposite sides of the Ni layer 4 (or the copper layer 5) as a core material are equal in thickness to each other to be symmetrical in the thickness direction. With this structure, it is possible to prevent the laminated metal thin plate from being deformed and distorted by a residual stress.

On the Ni—W alloy layer 6, a tungsten oxide film is formed, thereby providing a high acid resistance of the Ni—W alloy layer 6. However, in case where the Ni layer 4 is adhered to the Ni—W alloy layer 6 as described above, sufficient adhesion may not be assured between the Ni layer 4 and the Ni—W alloy layer 6 by presence of the tungsten oxide film, resulting in exfoliation of the Ni layer 4.

As shown in FIG. 2B, in order to avoid the above-mentioned problem, a copper (Cu) thin film 7 which exhibits strong adhesion with Ni is first electrodeposited on the Ni—W alloy layer 6. Thereafter, the Ni layer 4 is electrodeposited on the Cu thin film 7. In this case, the thickness of the Cu thin film 7 may be 0.01 to 0.5 μm.

On the other hand, a very thin Ni oxide layer is formed on the Ni layer 4. Similarly, in case where the Ni—W alloy layer 6 is formed on the Ni oxide layer, sufficient adhesion may not be assured between the Ni layer 4 and the Ni—W alloy layer 6 to cause exfoliation of the Ni—W alloy layer 6. In view of the above, another copper (Cu) thin film 7 which can be electrodeposited on the Ni layer and which exhibits excellent adhesion to the Ni—W alloy layer is formed between the Ni layer 4 and the Ni—W alloy layer 6. Thus, adhesion between these layers is sufficiently high. In this case, the thickness of another Cu thin film 7 may be 0.01-0.5 μm.

Third Embodiment

Referring to FIG. 3, a laminated metal thin plate according to a third embodiment of this invention comprises a plurality of Ni layers 4 or other metal layers and a plurality of Ni—W alloy layers 6 alternately laminated with Cu thin films 7 interposed therebetween. Alternatively, a plurality of Ni—W alloy layers 6 and a plurality of Cu layers 5 excellent in electrical conductivity are alternately laminated. The thickness of each layer is appropriately adjusted. Thus, mechanical, electrical, and temperature characteristics of the laminated metal thin plate are adjusted and deformation of the laminated metal thin plate due to the residual stress is easily suppressed.

Fourth Embodiment

Referring to FIGS. 4A through 4D, description will be made of a method of producing a laminated metal thin plate according to a fourth embodiment of this invention. In a first step illustrated in FIG. 4A, a photoresist material 9 is applied onto an electrode substrate 8 and is exposed through a photomask or the like having a desired pattern. Only an exposed part of the photoresist material 9 is developed and removed to form a three-dimensional cavity 10 having a desired shape. In a second step 2 illustrated in FIG. 4B, a plurality of metal layers 4 and 6 provided by two kinds of materials different in composition from each other are successively electrodeposited in the cavity 10 to form the laminated metal thin plate having a desired three-dimensional structure. In a third step illustrated in FIG. 4C, the resist material 9 is dissolved and removed by using a chemical agent. In a fourth step illustrated in FIG. 4D, the electrode substrate 8 is dissolved and removed by using a chemical agent. Thus, the laminated metal thin plate 11 having a desired three-dimensional structure is obtained.

Fifth Embodiment

Referring to FIGS. 5A and 5B, a rotary blade cutter according to a fifth embodiment of this invention is formed by a laminated metal thin plate which comprises a nickel-tungsten (Ni—W) alloy layer 6 covered with a nickel (Ni) layer 4. By the method described in conjunction with the fourth embodiment, the laminated metal thin plate is formed into a high-precision rotary disk shape with diamond fine particles 12 mixed into a peripheral part of the laminated metal thin plate during growth by the electrodeposition. By the electrodeposition, it is easy to make a thin blade having a thickness of about 20 μm. Such a very thin blade leaves only a narrow cutting gap or kerf (i.e., a slot the advancing blade leaves in the material) and therefore increases utilization efficiency of a material to be cut. Since the Ni—W alloy layer is used as a core material, the rotary blade cutter has an extremely high toughness and is not easily damaged. Simultaneously, the rotary blade cutter is excellent not only in acid resistance but also in alkali resistance because an outer surface of the rotary blade cutter is covered with the nickel layer as a chemically-resistant layer. Therefore, the rotary blade cutter is applicable to a wide variety of material processing. Instead of the nickel layer, a nickel-cobalt alloy layer, a nickel-iron alloy layer, a nickel-phosphorus alloy layer, a nickel-boron alloy layer, or the like may be used as the chemically-resistant layer. Moreover, other various chemically-resistant layers may be applicable.

In other words, the rotary blade cutter includes a hard layer having opposite surfaces covered with cover layers, respectively, which are made of at least one of the chemically-resistant layers and are equal in thickness to each other. In addition, the life-time of cutting performance of the rotary blade cutter is elongated by depositing a chromium thin film with the diamond fine particles on the outermost surface by the electrodeposition because the diamond fine particles are well doped and firmly held in the chromium metal.

As described above, the laminated metal thin plate according to each of the embodiments simultaneously has a high mechanical strength, a high toughness, a high temperature-stability, and a high electrical conductivity. Therefore, the laminated metal thin plate can be widely utilized as a fundamental material for micromachines, microparts, and rotary blade cutters for precision cutting or slicing. In particular, the laminated metal thin plate is an ideal material for contact parts as basic parts of two-dimensional high-density micro-connectors or micro-contactors (minute electrical contact probes) for an electric circuit. This invention also offers the rotary blade cutter which is improved in utilization efficiency of a material because of a small cutting gap and has a long life because of less damage.

While this invention has thus far been described in conjunction with the preferred embodiments thereof, it will be readily possible for those skilled in the art to put this invention into practice in various other manners without departing from the scope of this invention.

What is claimed is:

1. A laminated metal thin plate produced by electrodeposition, comprising:

a plurality of metal layers provided by at least two kinds of materials different in composition from each other, the metal layers being laminated integral with each other in atomic level at their interface;

wherein the metal layers include a first metal layer comprising a nickel-tungsten alloy layer and a second metal layer comprising one of a nickel layer, a nickel-cobalt alloy layer, a nickel-iron alloy layer, a nickel-phosphorus alloy layer, a nickel-boron alloy layer and a copper layer, and further include a third metal layer which is interposed as an adherence buffer layer between the first and the second metal layers.

2. The laminated metal thin plate according to claim 1, wherein the metal layers are adhered to each other with a composition gradient at their interface.

3. The laminated metal thin plate according to claim 1, wherein the metal layers are laminated to be symmetrical in a thickness direction with respect to a center of thickness.

4. The laminated metal thin plate according to claim 1, wherein the adherence buffer layer comprises a copper thin film whose thickness is less than 0.5 micrometers.

5. A method of producing, by electrodeposition, the laminated metal thin plate claimed in claim 1, the method comprising:

providing baths each of which contains respective ions of the metal, preparing an electrode substrate which acts as a cathode within all of the baths, successively electrodepositing a plurality of metal layers provided by at least two kinds of materials different in composition from each other on the electrode substrate; and finally dissolving the electrode substrate to form the laminated metal thin plate having an integral structure.

6. The method according to claim 5, wherein the metal layers are electrodeposited in a three-dimensional cavity having a desired shape so as to obtain the laminated metal thin plate having a desired three-dimensional structure.

7. A rotary blade cutter produced by the method claimed in claim 5, wherein the metal layers comprises a core layer of a disk-like shape and a cover layer covering all of outer surfaces of the core layer, the cover layer being provided by one of the materials and having a high chemical resistance, the core layer comprising a nickel-tungsten alloy layer as another one of the materials.

8. The rotary blade cutter according to claim 7, wherein the cover layer comprises, as the one of the materials, at least one of a nickel layer, a nickel-cobalt alloy layer, a nickel-iron alloy layer, a nickel-phosphorus alloy layer, and a nickel-boron alloy layer.

9. The rotary blade cutter according to claim 8, further comprising a chromium thin film laminated on an outer surface of the cover layer.

* * * * *